US009104154B2

(12) United States Patent
Fujiwara

(10) Patent No.: US 9,104,154 B2
(45) Date of Patent: Aug. 11, 2015

(54) IMAGE FORMING APPARATUS AND METHOD WHICH CONTROLS THE TEMPERATURE OF A FIXING APPARATUS

(71) Applicants: Kabushiki Kaisha Toshiba, Minato-ku, Tokyo (JP); Toshiba Tec Kabushiki Kaisha, Shinagawa-ku, Tokyo (JP)

(72) Inventor: Shigeru Fujiwara, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 15 days.

(21) Appl. No.: 14/037,505

(22) Filed: Sep. 26, 2013

(65) Prior Publication Data

US 2014/0105627 A1 Apr. 17, 2014

(30) Foreign Application Priority Data

Oct. 16, 2012 (JP) ..... 2012-229200

(51) Int. Cl.
*G03G 15/20* (2006.01)
*G03G 21/20* (2006.01)

(52) U.S. Cl.
CPC ..... *G03G 15/2078* (2013.01); *G03G 15/2017* (2013.01); *G03G 15/2039* (2013.01); *G03G 21/206* (2013.01)

(58) Field of Classification Search
CPC ..... G03G 15/2017; G03G 15/2039; G03G 15/2078; G03G 21/206
USPC ..... 399/67, 69, 92
See application file for complete search history.

(56) References Cited

U.S. PATENT DOCUMENTS

| | | | | | |
|---|---|---|---|---|---|
| 5,151,573 | A * | 9/1992 | Masuda | 219/216 |
| 5,475,194 | A * | 12/1995 | Watanabe et al. | 219/216 |
| 5,528,344 | A * | 6/1996 | Yamaguchi et al. | 399/13 |
| 5,647,727 | A * | 7/1997 | Taniguchi et al. | 417/32 |
| 5,666,187 | A * | 9/1997 | Kim | 355/30 |
| 5,701,554 | A * | 12/1997 | Tanaka et al. | 399/69 |
| 5,819,136 | A * | 10/1998 | Tomita et al. | 399/69 |
| 5,920,749 | A * | 7/1999 | Sugaya et al. | 399/69 |
| 6,253,042 | B1 * | 6/2001 | Yang | 399/92 |
| 6,324,361 | B1 * | 11/2001 | Itoh et al. | 399/92 |
| 6,996,441 | B1 * | 2/2006 | Tobias | 700/44 |
| 7,030,898 | B2 * | 4/2006 | Tsubota | 347/223 |
| 7,208,449 | B2 | 4/2007 | Sano | |
| 7,664,418 | B2 * | 2/2010 | Kotani | 399/70 |
| 8,218,993 | B2 * | 7/2012 | Kaji | 399/69 |
| 8,254,802 | B2 * | 8/2012 | Hanashi et al. | 399/92 |
| 2002/0012543 | A1 * | 1/2002 | Nakamura et al. | 399/69 |
| 2003/0219274 | A1 * | 11/2003 | Hirose et al. | 399/92 |

(Continued)

*Primary Examiner* — David Bolduc
(74) *Attorney, Agent, or Firm* — Amin, Turocy & Watson, LLP

(57) ABSTRACT

In accordance with one embodiment, an image forming apparatus includes an image forming section (1) configured to form a toner image on an image receiving medium; a fixing apparatus (20) configured to heat, using a heating component (21), the image receiving medium formed with the toner image to fix the toner image; a fan (66) configured to cool the heating component at least; and a control section (60) configured to enable, after the image forming section finishes an image forming operation, the fan to operate for a given time when the elapsed time for image forming operation is shorter than a first formation time, and enable the heating component to idle without generating heat while operating the fan, when the elapsed time for image forming operation is equal to or longer than the first time.

10 Claims, 7 Drawing Sheets

(56) References Cited

U.S. PATENT DOCUMENTS

| | | | | |
|---|---|---|---|---|
| 2004/0197108 | A1* | 10/2004 | Yamagata et al. | 399/21 |
| 2006/0083535 | A1* | 4/2006 | Shepherd et al. | 399/92 |
| 2006/0088326 | A1* | 4/2006 | Nakayama | 399/69 |
| 2006/0127119 | A1* | 6/2006 | Sato | 399/69 |
| 2007/0098432 | A1* | 5/2007 | Mashiki | 399/88 |
| 2007/0189798 | A1* | 8/2007 | Matsuno | 399/92 |
| 2007/0196119 | A1* | 8/2007 | Fujita | 399/68 |
| 2007/0292154 | A1* | 12/2007 | Ishikuro et al. | 399/67 |
| 2009/0142086 | A1* | 6/2009 | Cao et al. | 399/69 |
| 2009/0238598 | A1* | 9/2009 | Park | 399/70 |
| 2010/0142988 | A1* | 6/2010 | Kagawa et al. | 399/69 |
| 2010/0239277 | A1* | 9/2010 | Mohri et al. | 399/43 |
| 2010/0254726 | A1* | 10/2010 | Endo | 399/69 |
| 2011/0262165 | A1* | 10/2011 | Takeuchi et al. | 399/67 |
| 2011/0311262 | A1* | 12/2011 | Miyazaki et al. | 399/92 |
| 2012/0148290 | A1* | 6/2012 | Asami | 399/92 |
| 2012/0189325 | A1* | 7/2012 | Kushima et al. | 399/9 |
| 2012/0237273 | A1* | 9/2012 | Yoshinaga et al. | 399/328 |
| 2012/0294640 | A1* | 11/2012 | Arakawa | 399/69 |
| 2013/0084091 | A1* | 4/2013 | Taki et al. | 399/67 |

* cited by examiner

| CONTINUOUS PRINTING TIME (MIN) | FIXER FAN OPERATION TIME (SEC) | FIXER IDLING OPERATION TIME (SEC) |
|---|---|---|
| A<2 | 30 | 0 |
| 2≦A<4 | 15 | 15 |
| 4≦A<6 | 20 | 20 |
| 6≦A<10 | 25 | 25 |
| 10≦A | 30 | 30 |

(PRINTING TIME) 0 T1 T2 T3

| COOLING METHOD | AREA 1 | AREA 2 | AREA 3 |
|---|---|---|---|
| METHOD A | X | FAN | FAN+IDLING |
| METHOD B | X | FAN−IDLING | |
| METHOD C | FAN | FAN−IDLING | |
| METHOD D | FAN | | FAN+IDLING |

X : NO COOLING

IMAGE FORMING APPARATUS AND METHOD WHICH CONTROLS THE TEMPERATURE OF A FIXING APPARATUS

CROSS-REFERENCE TO RELATED APPLICATION

This application is based upon and claims the benefit of priority from Japanese Patent Application No. 2012-229200, filed Oct. 16, 2012, the entire contents of which are incorporated herein by reference.

FIELD

Embodiments described herein relate to an image forming apparatus.

BACKGROUND

An image forming apparatus (MFP: Multi-Functional Peripheral) operates in the following procedure. The image forming apparatus forms a toner image on the surface of a photoconductor and transfers the toner image on the photoconductor to an intermediate transfer body; the intermediate transfer body transfers the toner image to a medium; the medium transferred with the toner image passes through a fixing apparatus; the fixing apparatus heats and synchronously pressurizes two sides of the medium so as to fix the toner image on the medium; the medium passing the fixing apparatus is discharged to a paper discharging tray.

DETAILED DESCRIPTION

In accordance with one embodiment, an image forming apparatus includes an image forming section configured to form a toner image on an image receiving medium; a fixing apparatus configured to heat, using a heating component, the image receiving medium formed with the toner image to fix the toner image; a fan configured to cool the heating component at least; and a control section configured to enable, after the image forming section finishes an image forming operation, the fan to operate for a given time when the elapsed time for image forming operation is shorter than a first time, and enable the heating component to idle without generating heat while operating the fan, when the elapsed time for image forming operation is equal to or longer than the first time.

Embodiments of the present invention are described below. Further, an image forming apparatus using a color erasable toner is described in the following embodiment; however, the present invention is not limited to the embodiment.

Figure 1:
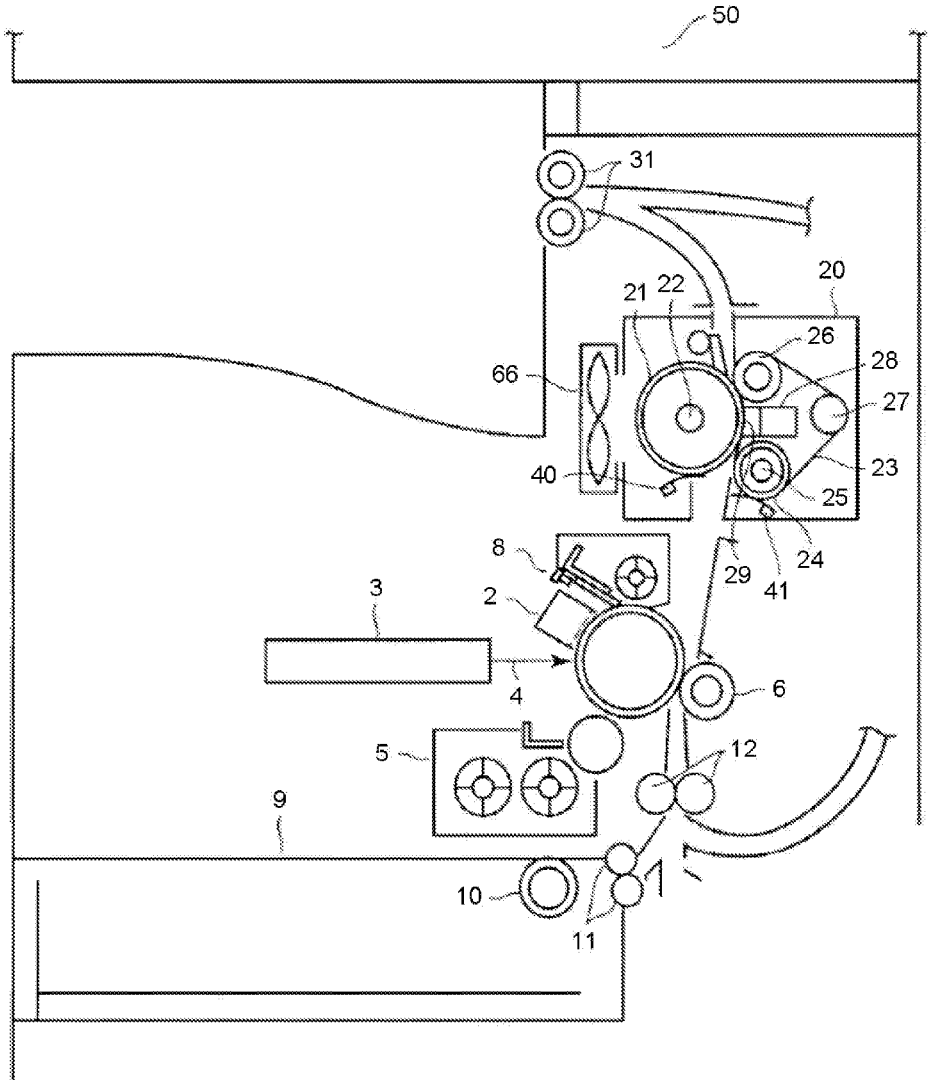
FIG. 1 is a schematic sectional view illustrating an image forming apparatus according to an embodiment.

FIG. 1 is a schematic sectional view illustrating an image forming apparatus according to the present embodiment.

The image forming apparatus comprises a photoconductive drum 1 and a corona charger 2, a laser exposure unit 3, a developer 5, a transfer roller 6, a cleaner 7 and a charge removing lamp 8 which are arranged around the photoconductive drum 1.

The photoconductive drum 1 has an organic photoconductor (OPC) on the surface thereof and is driven to rotate at a circumferential speed of 136 mm/sec by a drive mechanism with a main motor. The corona charger 2 is a scorotron type corona charger for charging the photoconductive drum 1 uniformly.

An original is scanned by a scanner 50 and converted to image data. A digitalized image signal is subjected to an image processing using an image processing circuit and is sent to a laser drive circuit. The laser drive circuit drives the laser exposure unit 3 to irradiate a laser (semiconductor laser) light corresponding to the image signal. An electrostatic latent image is formed on the photoconductive drum 1 at a resolution of, for example, 600 dpi through the scanning and exposing of a laser light 4.

A two-component developer including the mixture of a color erasable toner having a volume average particle diameter of 5-12 μm and a magnetic carrier having a volume average particle diameter of 30-80 μm is stored in the developer 5. Moreover, the toner is charge to negative polarity. The developing agent is fed from the developer 5 to the photoconductive drum 1 by a rotation mechanism to convert the electrostatic latent image on the photoconductive drum 1 to a toner image. Moreover, a toner concentration sensor (not shown) for detecting the toner concentration of the two-component developing agent is arranged in the developer 5. A toner is fed to the developer 5 from a toner cartridge corresponding to the detection output of the toner concentration sensor.

A paper feed apparatus 9 having a paper cassette stores unused papers or papers for reuse (papers the color of which is erased by a color erasing apparatus independent from the image forming apparatus). A paper is fed by a pickup roller 10 and a separation/conveyance roller 11. The paper fed from the paper feed apparatus 9 is conveyed to the photoconductive drum 1 by a register roller 12 at a proper timing.

A transfer bias having a positive polarity from a high voltage power source is applied to a transfer roller 6 arranged opposite to the photoconductive drum 1. As a result, the toner image formed on the photoconductive drum 1 is transferred to the paper conveyed while clamped between the photoconductive drum 1 and the transfer roller 6. The paper transferred with the toner image is subjected to fixing processing using the fixing apparatus 20 and then discharged to the outside by a paper discharging roller 31.

On the other hand, after the transfer residual toner left on the photoconductive drum 1 is cleaned by the cleaner 7, a charge removing lamp carries out a charge removing for the photoconductive drum 1 for the next electrostatic latent image formation.

A two-sided paper feed apparatus (not shown) is arranged on the right of the fixing apparatus 20.

A heat roller 21, a press belt 23, a belt heat roller 24, a press roller, a tension roller 27 and a press pad 29 are arranged in the fixing apparatus 20.

The heat roller 21 is a heating component for fixation and is a roller having a diameter of 45 mm inside which a halogen lamp 22 is arranged as a heat source. The press belt 23 is a press component which is contacted with the heat roller 21 in a twined way to form a nip. The belt heat roller 24 is a roller having a diameter of 20 mm. A halogen lamp 25 is arranged in the belt heat roller 24 to heat the press belt 23 from the inside of the press belt 23. The press roller 26 is a roller having a diameter of 18 mm. The press roller 26 presses the heat roller 21 across the press belt 23 at the exit side of the nip. The press pad 29 is a prismatic component having a width of 10 mm. The press pad 29 is fixed on a pad holder 28 to press the heat roller 21 across the press belt 23 at the center of the nip. The tension roller 27 applies a tension to the press belt 23.

Further, a thermistor (temperature sensor) 40 is arranged in a contacted manner on the heat roller 21, and a thermistor (temperature sensor) 41 is also arranged in a contacted manner on the press belt 23.

The nip between the heat roller 21 and the press belt 23 is about 27 mm, and the nip passing time of a paper is about 0.2 second. The heat roller 21 serving as the heating component contacted with the unfixed toner image on a paper has a fluororesin PFA (copolymer of tetrafluoroethylene and Perfluo alkyl vinyl ether) layer of about 25 μm serving as a release layer on the aluminum roller substrate having a wall thickness of 1.0 mm. The press belt 23 serving as a press component has a silicone rubber layer having a thickness of 200 μm and a fluororesin PFA layer of about 30 μm serving as a release layer on the nickel belt substrate having a thickness of about 40 μm.

Drive mechanisms for driving each section of the fixing apparatus 20 to rotate are arranged independently. That is, the heat roller 21 is driven by a drive mechanism including a fixer motor different from a main motor for driving the photoconductive drum 1. Further, the press belt 23 is driven to rotate along with the rotation of the heat roller 21.

Further, a fixer fan 66 is arranged on the fixing apparatus 20 mainly to cool the heat roller 21 by blowing air.

Figure 2:
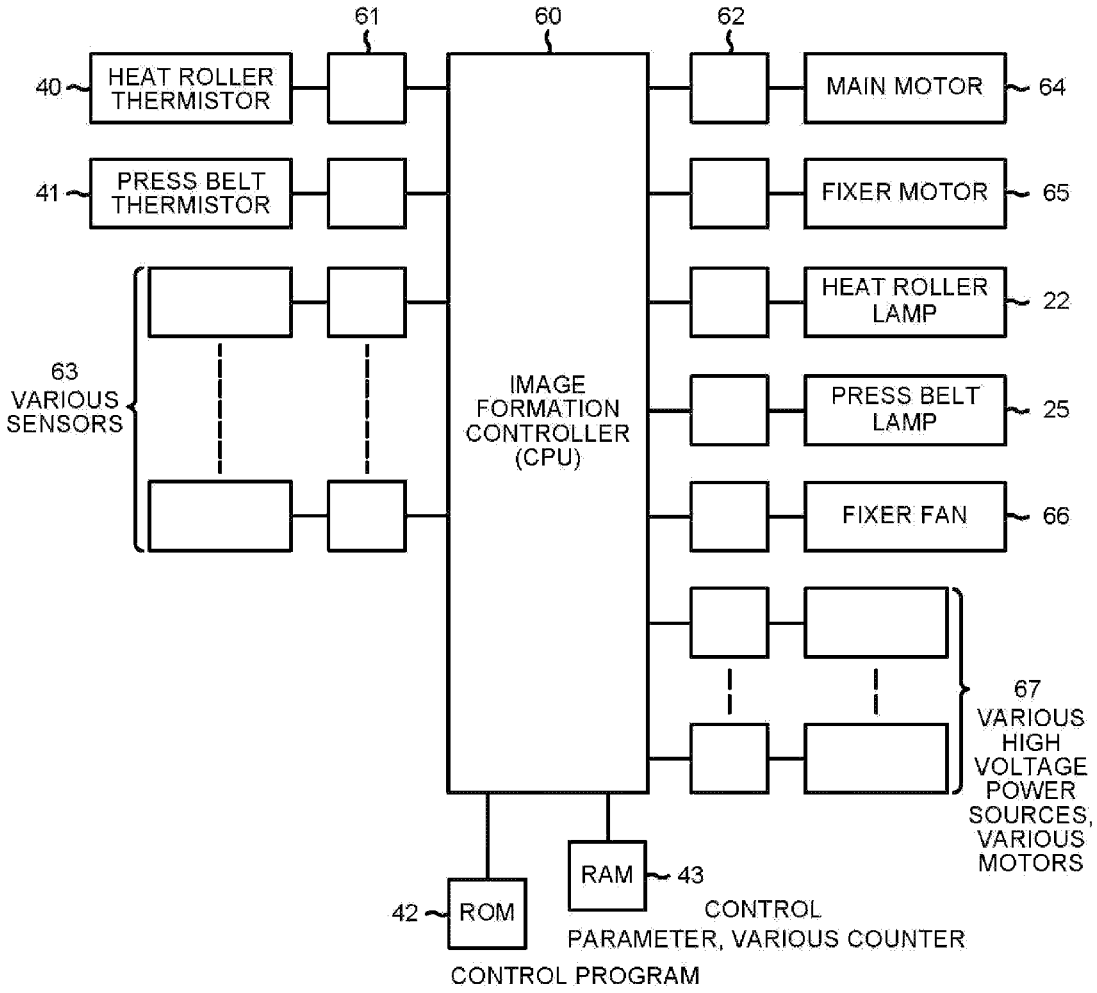
FIG. 2 is a control block diagram illustrating an image forming apparatus according to the present embodiment.

FIG. 2 is a control block diagram illustrating the image forming apparatus according to the present embodiment.

An image formation controller 60 uniformly controls the operation of the image forming apparatus, including the temperature control on the fixing apparatus 20. The image formation controller 60 is connected with various input/output devices.

The image formation controller 60 is connected with the heat roller thermistor 40, the press belt thermistor 41 and various sensors 63 serving as input devices through an analog-digital converter (A/D) 61.

The heat roller thermistor 40 measures the surface temperature of the heat roller 21. The press belt thermistor 41 measures the surface temperature of the press belt. The various sensors 63 measure various physical quantities for controlling the formation of an image.

The image formation controller 60 is connected with a main motor 64, a fixer motor 65, a heat roller lamp 22, a press belt lamp 25, a fixer fan 66 which serve as output devices and a high voltage power source and various motors 67 for the formation of an image through a circuit 62 (e.g. a switching circuit as driving device or a digital-analogue converter (D/A) and the like).

The image formation controller 60 is connected with a ROM 42 and a RAM 43 serving as input/output devices. The ROM 42 stores control programs and control data for controlling the image forming apparatus. The RAM 43 stores control parameters and the number of printings, printing time and continuous printing time and the like of counted consumables.

Then, the color erasable toner used in the image forming apparatus of the present embodiment is described. The color erasable toner is a capsule erasable toner which is erased by heating and is prepared using the following chemical method:

(1) binder resin and WAX atomized solution the binder resin is a polyester resin; prepare a resin atomized solution with the polyester resin, an anionic emulsifier, a neutralizing agent using a high pressure homogenizer.

(2) adjusting of WAX dispersion obtain a atomized solution with a rice WAX in the way the aforementioned resin is prepared.

(3) toner adjusting leuco dye: CVL (Crystal Violet Lactone)

developing agent: 4-Hydroxybenzoic acid Benzyl temperature controlling agent: lauric acid-4-Benzyloxyphenylethyl prepare a toner by heating and melting the materials above, encapsulating the solution using the well-known coacervation method, agglutinating and blending the encapsulated coloring material, the toner binder resin dispersion and the WAX dispersion with sulfuric acid Al (Al2(SO4)3), washing and drying the material obtained; then, add a proper external additive into the toner; the toner is hereinafter referred to as a capsule color-erasable toner.

The true specific gravity of the capsule color-erasable toner is in a range of about 0.9-1.2 g/cm$^3$. It is prepared that the 10 wt % of the toner before external addition is the quantity of the encapsulated coloring material. The encapsulated coloring material used in the toner has a characteristic of starting to erase at 105 degrees centigrade and completely being erased at 108-110 degrees centigrade.

Next, the temperature of the heat roller after a printing job is described.

Figure 3:
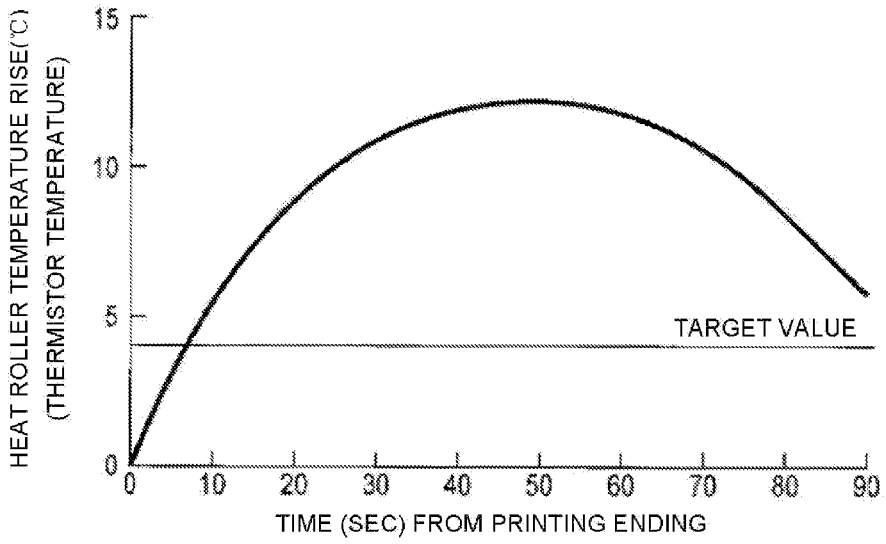
FIG. 3 is a diagram illustrating a temperature transition of a heat roller from the ending of printing in an image forming apparatus according to the present embodiment.

FIG. 3 is a diagram illustrating a temperature transition of the heat roller from the ending of printing in the image forming apparatus according to the present embodiment. FIG. 3 shows the temperature rise of the heat roller 21 (the temperature of the heat roller thermistor) after 300 pieces of paper (in about 10 minutes) is printed continuously.

In FIG. 3, the ordinate represents the temperature rise (degree centigrade) of the heat roller 21, and the abscissa represents the time (sec) elapsing from the ending of a printing job. The target temperature refers to a temperature at which the color-erasable toner is not color-erased. The target temperature is set to 4 degrees centigrade (100 degrees centigrade−96 degrees centigrade) as the control temperature of the heat roller 21 is 96 degrees centigrade. Moreover, the control temperature of the press belt 23 is set to 86 degrees centigrade in this case.

According to FIG. 3, temperature rises about 12 degrees centigrade at about 40 seconds after the ending of a printing job. Therefore, the toner on a printed paper may be erased if a next printing job is executed after the former printing job is ended. Moreover, the reason for the temperature rise of the heat roller 21 after the ending of a continuous printing operation lies in that the filament of the heat roller lamp (halogen lamp) 22 arranged in the heat roller 21 becomes very hot in the continuous printing, and the heat still exists even through the heat roller lamp 22 is turned off after the printing operation.

Thus, the heat roller 21 needs to be cooled mainly after a printing job is ended. A method for cooling the heat roller 21 is discussed below.

Figure 4:
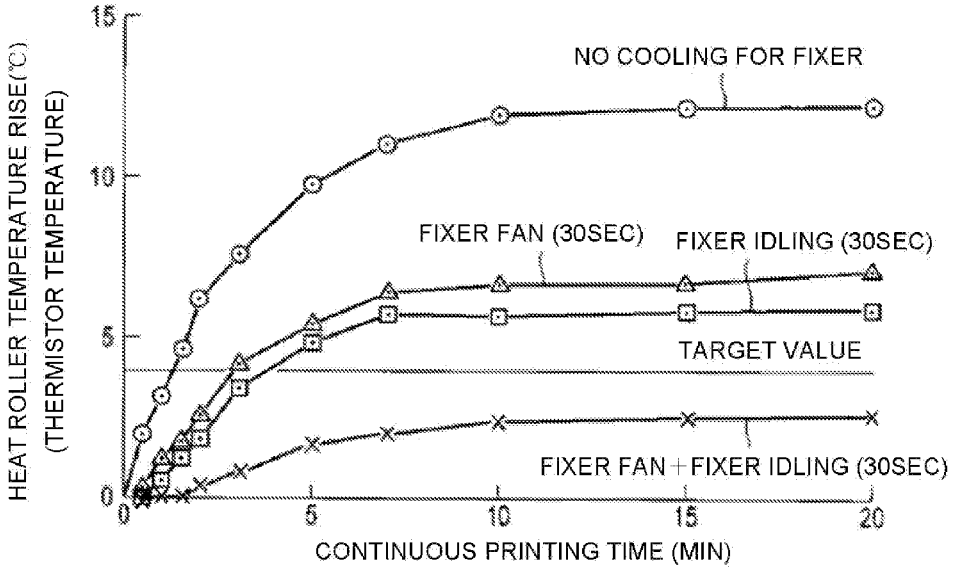
FIG. 4 is a diagram illustrating a relation between a continuous printing time and a temperature rise value (a peak temperature value) when various cooling operations are carried out in an image forming apparatus according to the present embodiment.

FIG. 4 is a diagram illustrating the relation between a continuous printing time and the temperature rise value (peak temperature value) of the heat roller when various cooling operations are carried out in the image forming apparatus according to the present embodiment.

FIG. 4 comprehensively shows a check result on the temperature transition in the following cases. Specifically, a check is carried out in the following four cases: (case 1) no cooling; (case 2) cool with the fixer fan 66 (for 30 seconds); (case 3) cool through the idling of the fixing apparatus (for 30 seconds); and (case 4) cool with the fixer fan 66 while the fixing apparatus is idling (for 30 seconds).

Herein, the idling of the fixing apparatus refers to an operation of rotating the heat roller 21 without conveying the paper in a state that the heat roller lamp 22 is turned off. In the present embodiment, the heat roller 21 is contacted with the press belt 23 in this case. However, the present invention is not limited to this, and the heat roller 21 may be separated from the press belt 23 and rotated separately.

In the case 1 of no-cooling, the temperature rise value increases in response to the increase of the continuous printing time and exceeds the target value of 4 degrees centigrade when the continuous printing time is about 1.5 minutes, and substantially reaches a saturation value of 12 degrees centigrade when the continuous printing time is about 10 minutes.

A cooling effect is achieved in both the case 2 of cooling with the fixer fan 66 (for 30 seconds) and the case 3 of cooling through the idling of the fixing apparatus (for 30 seconds). That is, the temperature rise value is below the target value of 4 degrees centigrade when the continuous printing time is shorter than 3 minutes. However, the temperature rise value exceeds the target value of 4 degrees centigrade when the continuous printing time is above 3 minutes, and substantially reaches a saturation value of 6 degrees centigrade when the continuous printing time is about 10 minutes.

Abetter cooling effect is achieved in the case 4 of cooling with the fixer fan 66 while the fixing apparatus is idling (for 30 seconds), and in this case, the temperature rise value is always below the target value of 4 degrees centigrade no matter how long the continuous printing time is.

Figures 5, 6:
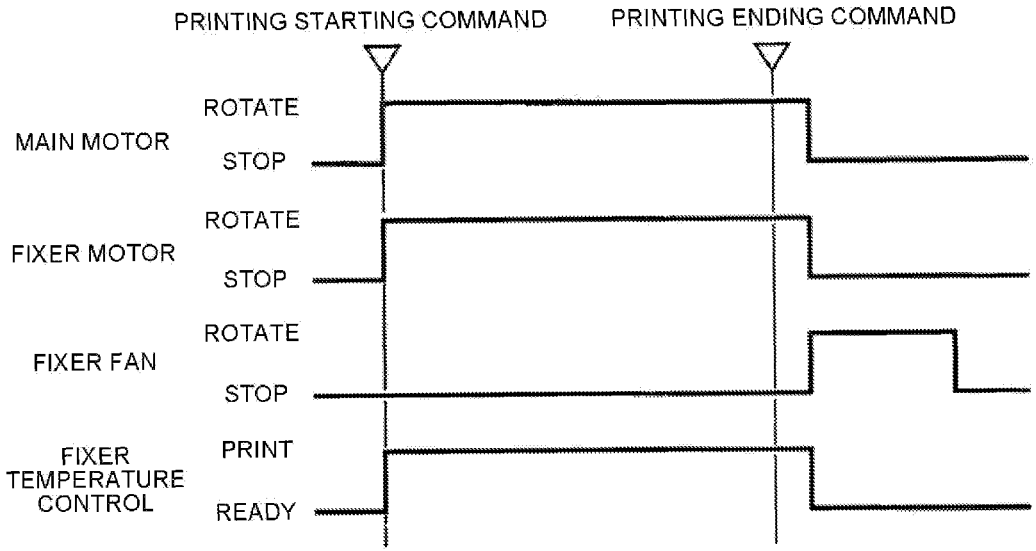
FIG. 5 is a diagram illustrating an example of a cooling method used in an image forming apparatus according to the present embodiment.
FIG. 6 is a timing chart illustrating a case where a fixer fan is enabled to operate after a printing job is ended in an image forming apparatus according to the present embodiment.

FIG. 5 is a diagram illustrating an example of the cooling method used in the image forming apparatus according to the present embodiment. According to this cooling method, when the continuous printing time is less than 2 minutes, the fixer fan 66 is enabled to operate for 30 seconds without idling the fixing apparatus. When the continuous printing time is longer than 10 minutes, cooling operation is executed using the fixer fan 66 while the fixing apparatus is idling (for 30 seconds). When the continuous printing time is longer than 2 but shorter than 10 minutes, cooling operation is executed using the fixer fan 66 while the fixing apparatus is idling, and the time of the cooling operation is changed corresponding to the continuous printing time.

According to the cooling method, the fixer fan 66 is enabled to operate without idling the fixing apparatus when the continuous printing time is short and the fixer fan 66 is enabled to operate while the fixing apparatus is idling when the continuous printing time is long. That is because idling operation of the fixing apparatus 20 affects service life of the components of the fixing apparatus 20 such as the heat roller 21, the press belt 23 and the like, thus, the idling time should be shortened as much as possible so as to prevent the reducing of the service life.

Moreover, in the present embodiment, the drive mechanisms of the image forming sections (e.g. the photoconductive drum, the transfer roller) and the drive mechanism of the fixing apparatus of the image forming apparatus are arranged independently. However, it may be also set that a common drive mechanism is used to drive both image forming sections and a fixing apparatus in the image forming apparatus. In such an image forming apparatus, the aforementioned idling operation affects not only the service life of the fixing apparatus but also the service lives of the image forming sections.

Further, a cooling time of 30 seconds is set as 30 seconds is appropriate for the basic operation of the image forming apparatus. That is, if a state in which the image forming apparatus doesn't carrying out any operation continuously lasts for a given time, the power supplied to main sections of the image forming apparatus is turned off and the image forming apparatus transits to a sleep state. The given time is a value (default value=1 min) set for the sake of energy (power) saving. Thus, the cooling time (30 seconds) is also set to be a value appropriate for the basic operation. That is, 30 seconds is a time shorter than the time elapsing before a transition to a sleep state and is a value selected to achieve the best cooling effect.

FIG. 6 is a timing chart illustrating a case where the fixer fan 66 is enabled to operate after the printing of the image forming apparatus is ended according to the present embodiment.

The counting on a continuous printing time is started when the image formation controller 60 receives a printing starting command based on, for example, the press on a start button of the starting of a printing job. The counting on the continuous printing time is ended when it is determined that a printing job is ended and a printing ending command is received. After receiving a printing ending command and controlling an operation of ending a printing job, the image formation controller 60 enables the fixer fan 66 to operate for a given time corresponding to the counted continuous printing time.

Figure 7:
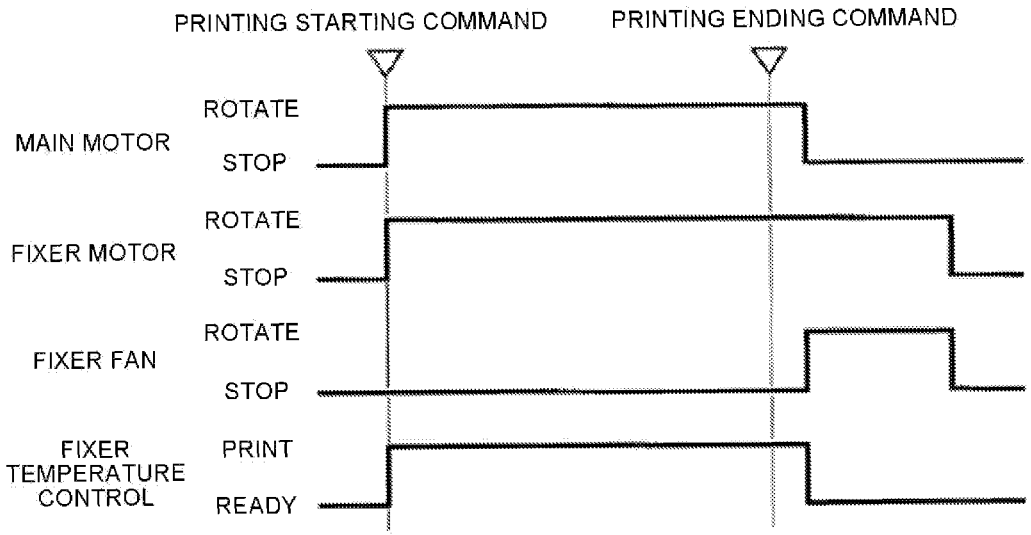
FIG. 7 is a timing chart illustrating a case where a fixer fan is enabled to operate while a fixing apparatus is idling after a printing job is ended in an image forming apparatus according to the present embodiment.

FIG. 7 is a timing chart illustrating a case where the fixer fan 66 is enabled to operate while the fixing apparatus is idling after a printing job is ended in the image forming apparatus according to the present embodiment.

The counting on a continuous printing time is started when the image formation controller 60 receives a printing starting command based on, for example, the press on a start button indicating the start of a printing job. The counting on the continuous printing time is ended when it is determined that a printing job is ended and a printing ending command is received. After receiving the printing ending command, the image formation controller 66 enables the fixer fan 66 to operate for a given time corresponding to the continuous printing time while the fixing apparatus 20 is made to idle, without stopping the fixer motor 65 for driving the heat roller 21 after a counted printing job is ended. Then, the fixer motor 65 and the fixer fan 66 are stopped synchronously.

Figure 8:
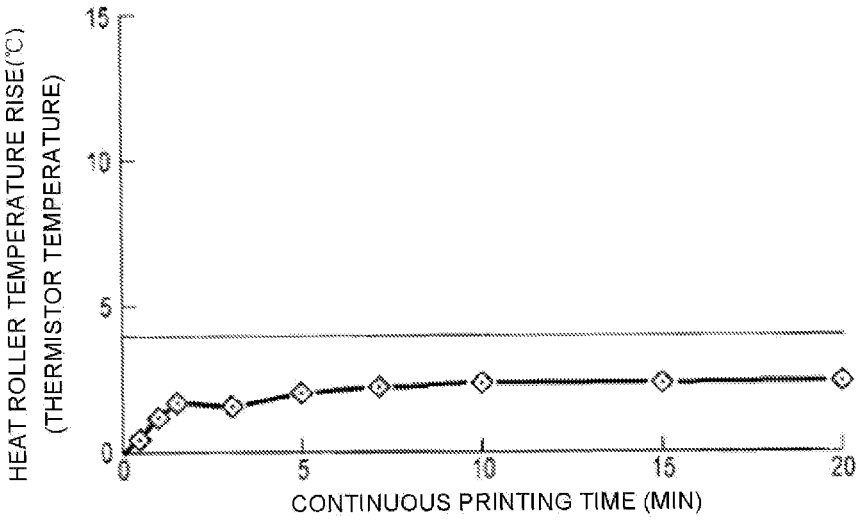
FIG. 8 is a diagram illustrating an application result of the cooling method shown in FIG. 5 to an image forming apparatus according to the present embodiment.

FIG. 8 is a diagram illustrating an application result of the cooling method shown in FIG. 5 to the image forming apparatus according to the present embodiment. The temperature rise value of the heat roller 21 finishing the continuous printing is below a target value, that is, below 4 degrees centigrade.

Figures 9, 10:
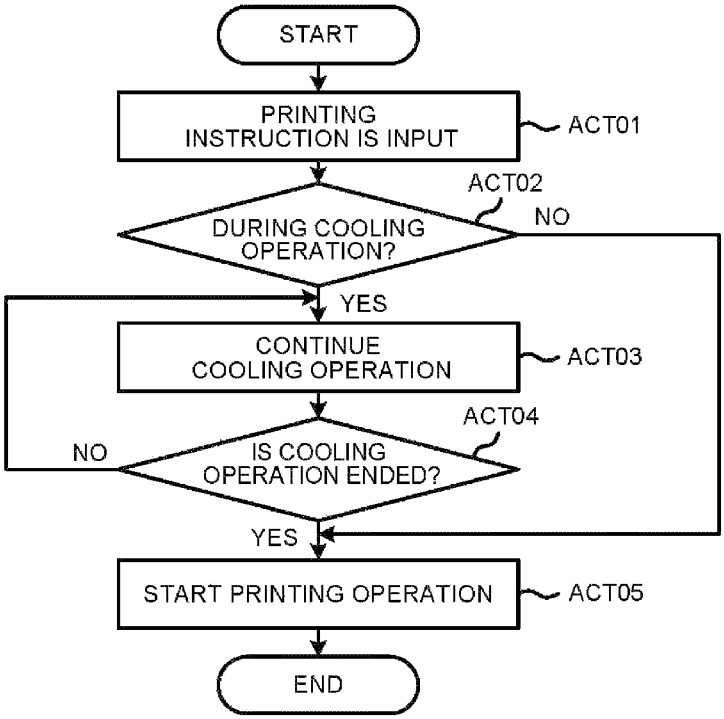
FIG. 9 is a diagram illustrating variations of a cooling method used in an image forming apparatus according to the present embodiment.
FIG. 10 is a flowchart illustrating a processing procedure when a new printing instruction is input in a cooling operation in an image forming apparatus according to the present embodiment.

FIG. 9 is a diagram illustrating variations of the cooling method used in the image forming apparatus according to the present embodiment.

It can be known from the check result illustrated in FIG. 4 that the continuous printing time can be divided into three areas in the case where the cooling is achieved by the fixer fan 66 and in the case where the cooling is achieved through the idling of the fixing apparatus.

Area 1 is an area in which the continuous printing time is shorter than T1 (Min); no cooling is needed in this area.

Area 2 is an area in which the continuous printing time is in a range from T1 (Min) to T2 (Min); in this area, a cooling job can be achieved by either the fixer fan 66 or the idling of the fixing apparatus.

Area 3 is an area in which the continuous printing time is longer than T2 (Min); in this area, a cooling job is achieved by both the fixer fan 66 and the idling of the fixing apparatus. Further, the area 3 can be divided into a sub-area in which the continuous printing time is longer than T3 (Min) and the temperature rise value is saturated, and a sub-area in which the continuous printing time is in a range from T2 (Min) to T3 (Min) and the temperature rise value is not saturated.

Next, variations of the cooling method shown in FIG. 9 are illustrated.

In a cooling method A, no cooling job is carried out in area 1; a cooling job is carried out using the fixer fan 66 for a given time in area 2, and a cooling job is carried out through the fixer fan 66 and the idling of the fixing apparatus in area 3. Moreover, in area 3, the cooling time can be changed corresponding to the continuous printing time when the continuous printing time is in a range from T2 (min) to T3 (min).

In a cooling method B, no cooling job is carried out in area 1, and a cooling job is carried out through the fixer fan 66 and the idling of the fixing apparatus in areas 2 and 3. Moreover, in areas 2 and 3, the cooling time can be changed corresponding to the continuous printing time when the continuous printing time is in a range from T1 (min) to T3 (min).

In a cooling method C, a cooling job is carried out using the fixer fan 66 for a given time in area 1, and a cooling job is carried out through the fixer fan 66 and the idling of the fixing apparatus in areas 2 and 3. Moreover, in areas 2 and 3, the cooling time can be changed corresponding to the continuous printing time when the continuous printing time is in a range from T1 (min) to T3 (min).

In a cooling method D, a cooling job is carried out using the fixer fan 66 for a given time in areas 1 and 2; and a cooling job is carried out through the fixer fan 66 and the idling of the fixing apparatus in area 3. Moreover, in area 3, the cooling time can be changed corresponding to the continuous printing time when the continuous printing time is in a range from T2 (min) to T3 (min).

In all the cooling methods above, it is preferred to carry out a cooling job using the fixer fan 66 first, and it is preferred to carry out a cooling job through the fixer fan 66 and the idling of the fixer apparatus when the two cooling methods are needed. Thus, service lives of the components of the fixing apparatus will not be shortened sharply, and the temperature rise of the fixing component (heat roller) can be restricted, which greatly reduces the damage caused by the heat load of the image forming apparatus.

Next, an operation carried out when a new printing instruction is input during a cooling job is described.

FIG. 10 is a flowchart illustrating a processing procedure when a new printing instruction is input during a cooling job in the image forming apparatus according to the present embodiment.

If a printing instruction is input in ACT 01, then the image formation controller 60 checks whether or not the fixing apparatus is being cooled in ACT 02. If the fixing apparatus is not being cooled (NO in ACT 02), the image formation controller 60 starts a printing operation in ACT 05.

If the fixing apparatus is being cooled (YES in ACT 02), the image formation controller 60 continues to execute the cooling operation while suspending the start of the printing operation in ACT 03. Whether or not the cooling operation is ended is checked in ACT 04. If the cooling operation is not ended (NO in ACT 04), the cooling operation in ACT 03 is continued, and if the cooling operation is ended (YES in ACT 04), the image formation controller 60 starts a printing operation in ACT 05.

In accordance with the processing procedure, since a printing operation is started after a specific cooling operation is ended, the image formed with a color erasable toner will not be erased in the started printing operation, thus guaranteeing a certain fixation.

Figure 11:
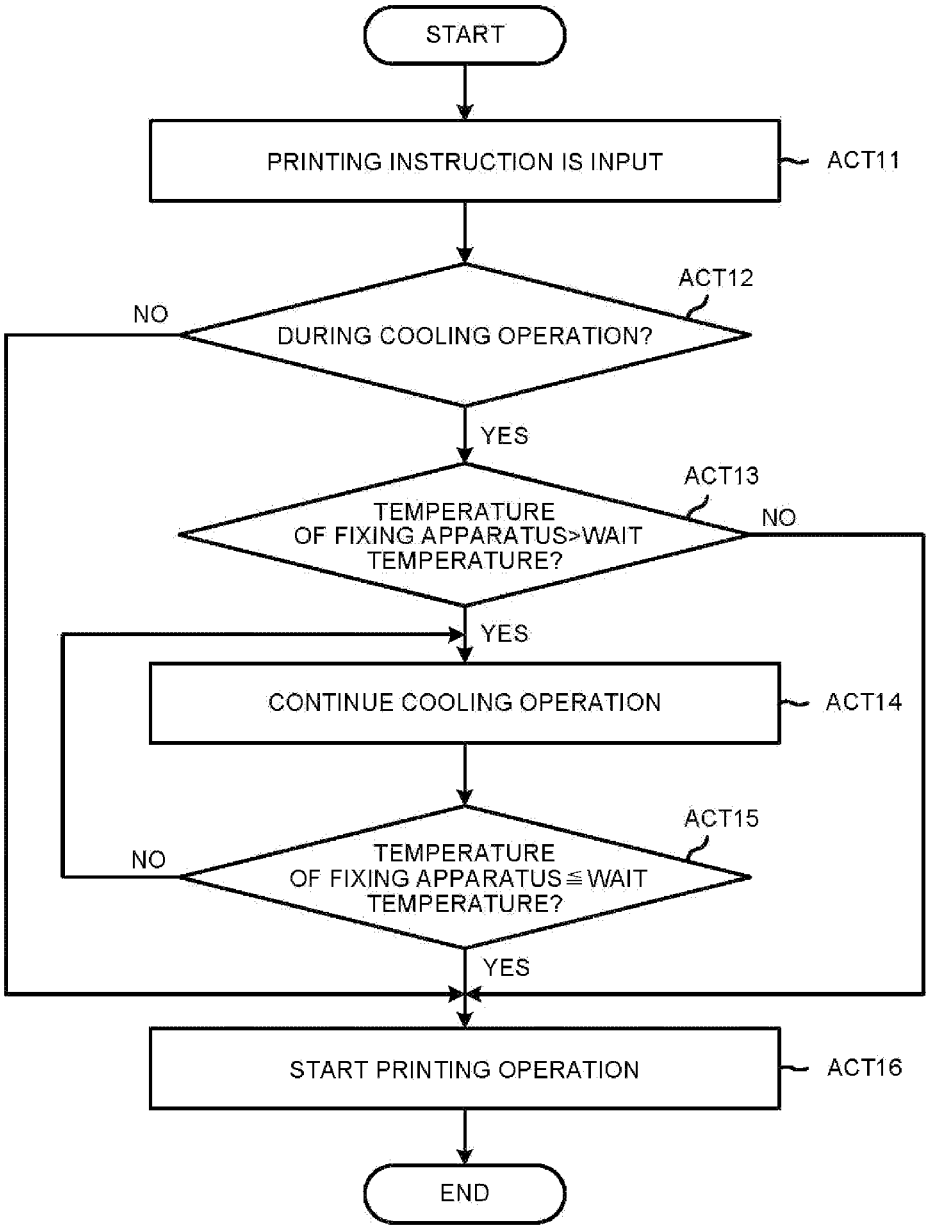
FIG. 11 is a flowchart illustrating a variation of a processing procedure when a new printing instruction is input in a cooling operation in an image forming apparatus according to the present embodiment.

FIG. 11 is a flowchart illustrating a variation of a processing procedure when a new printing instruction is input during a cooling operation in the image forming apparatus according to the present embodiment.

If a printing instruction is input in ACT 11, then the image formation controller 60 checks whether or not the fixing apparatus is being cooled in ACT 12. If the fixing apparatus is not being cooled (NO in ACT 12), the image formation controller 60 starts a printing operation in ACT 16.

If the fixing apparatus is being cooled (YES in ACT 12), the image formation controller 60 checks whether or not the temperature of the fixing apparatus is higher than a Wait temperature in ACT 13. If the temperature of the fixing apparatus is below the Wait temperature (NO in ACT 13), the image formation controller 60 starts a printing operation in ACT 16.

If the temperature of the fixing apparatus is higher than the Wait temperature (YES in ACT 13), the image formation controller 60 continues to execute the cooling job while suspending the printing operation in ACT 14. In ACT 15, if the temperature of the fixing apparatus is higher than the Wait temperature (NO in ACT 15), the cooling operation in ACT 14 is continued, and if the temperature of the fixing apparatus is equal to or below the Wait temperature (YES in ACT 15), the image formation controller 60 ends the cooling operation and starts a printing operation in ACT 16.

In accordance with the processing procedure, whether or not to end the cooling operation is determined by monitoring the temperature of the fixing apparatus, thus an efficient cooling job can be carried out.

Further, an example of using a color-erasable toner is described in the embodiment above, apparently, it is not limited to this, an ordinary (color-inerasable) toner maybe used as well.

Further, the functions described in the embodiments above may be achieved by hardware, or be achieved by reading a program recorded with each function using hardware into a computer. Further, each function may be achieved by selecting an appropriate software or hardware.

Further, each function may be achieved by reading a program stored in an image receiving medium (not shown) into a computer. The form of the image receiving medium described in the present embodiment herein is not limited as long as the image receiving medium can store programs and is readable by a computer.

In addition, the present invention is not limited to the aforementioned embodiment, and various other embodiments can be devised without departing from the scope of the present invention.

In addition, various inventions can be devised by combining a proper number of the components disclosed herein. For example, several of the components shown in the embodiment may be deleted. Further, components of different embodiments may be combined in a proper way.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form a toner image on an image receiving medium;

a fixing apparatus configured to heat the image receiving medium having formed thereon the toner image to fix the toner image;

a fan configured to cool around the fixing apparatus; and a control section configured to operate, after an image forming operation by the image forming section, the fan if an elapsed time for image forming is shorter than a first time, and to drive the fixing apparatus for idling while operating the fan if the elapsed time for image forming operation is equal to or longer than the first time.

2. An image forming apparatus, comprising:

an image forming section configured to form a toner image on an image receiving medium;

a fixing apparatus configured to heat the image receiving medium having formed thereon the toner image to fix the toner image;

a fan configured to cool around the fixing apparatus; and a control section configured to operate, after an image forming operation by the image forming section, the fan if an elapsed time for image forming is shorter than a first time and equal to or longer than a second time shorter than the first time, and to drive the fixing apparatus for idling while operating the fan if the elapsed time for image forming is equal to or longer than the first time, wherein the control section sets an operation time of the fan to 0 if the elapsed time for image forming is shorter than the second time.

3. The image forming apparatus according to claim 1, wherein the control section sets driving time of the fixing apparatus and an operation time of the fan in proportion to the elapsed time for image forming if the elapsed time for image forming is equal to or longer than the first time but shorter than a third time, and sets the driving time of the fixing apparatus and the operation time of the fan to be a predetermined time if the elapsed time for image forming is equal to or longer than the third time.

4. The image forming apparatus according to claim 1, wherein the image forming section suspends a new image forming operation until at least one of the operating of the fan and the driving of the fixing apparatus is completed.

5. The image forming apparatus according to claim 1, further comprising a temperature sensor configured to detect a temperature of the fixing apparatus, wherein the image forming section suspends a new image forming operation until the temperature detected by the temperature sensor is below a predetermined temperature.

6. A method comprising:

forming a toner image on an image receiving medium;

heating, by a fixing apparatus, the image receiving medium having formed thereon the toner image to fix the toner image; and controlling a fan and the fixing apparatus to cool the fixing apparatus, wherein the controlling comprises, after an image forming operation, operating the fan if an elapsed time for image forming is shorter than a first time, and driving the fixing apparatus for idling while operating the fan if the elapsed time for image forming is equal to or longer than the first time.

7. A method comprising:

forming a toner image on an image receiving medium;

heating, by a fixing apparatus, the image receiving medium having formed thereon the toner image to fix the toner image; and controlling a fan and the fixing apparatus to cool the fixing apparatus, wherein the controlling comprises, after an image forming operation, operating the fan if an elapsed time for image forming is shorter than the first time and equal to or longer than a second time shorter than the first time, driving the fixing apparatus for idling while operating the fan if the elapsed time for image forming is equal to or longer than the first time, and setting an operation time of the fan to 0 if the elapsed time for image forming is shorter than the second time.

8. The method according to claim 6, wherein the controlling comprises:

setting a driving time of the fixing apparatus and an operation time of the fan in proportion to the elapsed time for image forming if the elapsed time for image forming is equal to or longer than the first time but shorter than a third time, and setting the driving time of the fixing apparatus and the operation time of the fan to be a predetermined time if the elapsed time for image forming is equal to or longer than the third time.

9. The method according to claim 6, further comprising:

suspending a new image forming operation until at least one of the operating of the fan and the driving of the fix apparatus is complete.

10. The method according to claim 6, further comprising:

detecting a temperature of the fixing apparatus; and suspending a new image forming operation until the detected temperature is below a predetermined temperature.

* * * * *